United States Patent [19]

Orea Mateo

[11] Patent Number: 4,523,345

[45] Date of Patent: Jun. 18, 1985

[54] LAST WITH A REPLACEABLE TIP

[75] Inventor: Fernando Orea Mateo, Madrid, Spain

[73] Assignee: Ingenieria del Calzado, S.A. (I.C.A.S.A.), Madrid, Spain

[21] Appl. No.: 539,957

[22] Filed: Oct. 7, 1983

[30] Foreign Application Priority Data

Oct. 7, 1982 [ES] Spain ..... 267.684

[51] Int. Cl.[3] ..... A43D 3/02; A43D 3/00

[52] U.S. Cl. ..... 12/133 R; 12/135 R; 12/134

[58] Field of Search ..... 12/137, 138, 133 R, 12/133 A, 133 B, 133 C, 134, 135 R, 135 A, 139, 136 A

[56] References Cited

U.S. PATENT DOCUMENTS

| | | | |
|---|---|---|---|
| 241,136 | 5/1881 | Holden | 12/133 R |
| 1,496,091 | 6/1924 | May | 12/135 A |
| 2,043,649 | 6/1936 | Bliss | 12/133 R |
| 2,076,931 | 4/1937 | Adams | 12/135 R |
| 2,093,247 | 9/1937 | Lucas | 12/133 R |
| 2,426,810 | 9/1947 | Ayers | 12/135 R |

FOREIGN PATENT DOCUMENTS

| | | | |
|---|---|---|---|
| 58667 | 1/1891 | Fed. Rep. of Germany | 12/133 R |
| 17971 | of 1889 | United Kingdom | 12/135 R |
| 2069816 | 9/1981 | United Kingdom | 12/7 |

*Primary Examiner*—Henry S. Jaudon
*Assistant Examiner*—Steven N. Meyers
*Attorney, Agent, or Firm*—Wenderoth, Lind & Ponack

[57] ABSTRACT

A last structure includes a main body portion and a plurality of toe portions selectively joinable thereto. A plurality of interchangeable intermediate members are adapted to be selectively connected between the main body portion and a selected toe portion, thereby to adjust the last structure to various heel heights of shoes to be formed thereon. Each intermediate member has a rear surface to abut a complementary forward surface of the main body portion and a forward surface to abut a complementary rear surface of the selected toe portion. The rear and forward surfaces of each intermediate member extend at a relative orientation different from that of other intermediate members. A respective intermediate member is connected between the main body portion and the selected toe portion by a structure to accommodate changes of orientation.

8 Claims, 6 Drawing Figures

LAST WITH A REPLACEABLE TIP

BACKGROUND OF THE INVENTION

The present invention relates to a last with a replaceable tip or toe portion, certain fundamental aspects of which have been improved considerably to enhance the structure and effectiveness thereof.

Shoe lasts are made from a solid body provided with a corresponding unmolding wedge or block. In this type of last, a different last is necessary for each type of shoe, referring to model and size.

Also known is a last which is a prototype for various models and sizes and which has a replaceable tip so that the same last can be adapted to different shoe designs, depending only and exclusively on modifications of the tip. This type of last, apart from comprising a prototype for various models and sizes, also may form a single prototype for various shoe models which, although identical in size and design, differ with respect to the heights of the heels.

SUMMARY OF THE INVENTION

An object of the invention is to provide a last having a main body an which can be used for various prototypes, irrespective of the design, size and height of the heel thereof.

A further object of the present invention is to provide between the solid body of the last and its replaceable tip a complementary ring or member which may be replaced by other members with different angled surfaces corresponding to the height of the heel of the desired shoe.

Generally, the invention resides in arranging between a forward surface of the solid body and a rear surface of the tip, a third member having surfaces extending at angular positions differing from one another, depending on the height to be given to the shoe.

Another characteristic of the invention resides in means for joining the tip to the solid body of the last through the third member.

BRIEF DESCRIPTION OF THE DRAWINGS

To complement the following description which will now be made and for a better understanding of the characteristics of the invention, reference is made to the accompanying drawings, wherein.

DETAILED DESCRIPTION OF THE INVENTION

Figure 1:
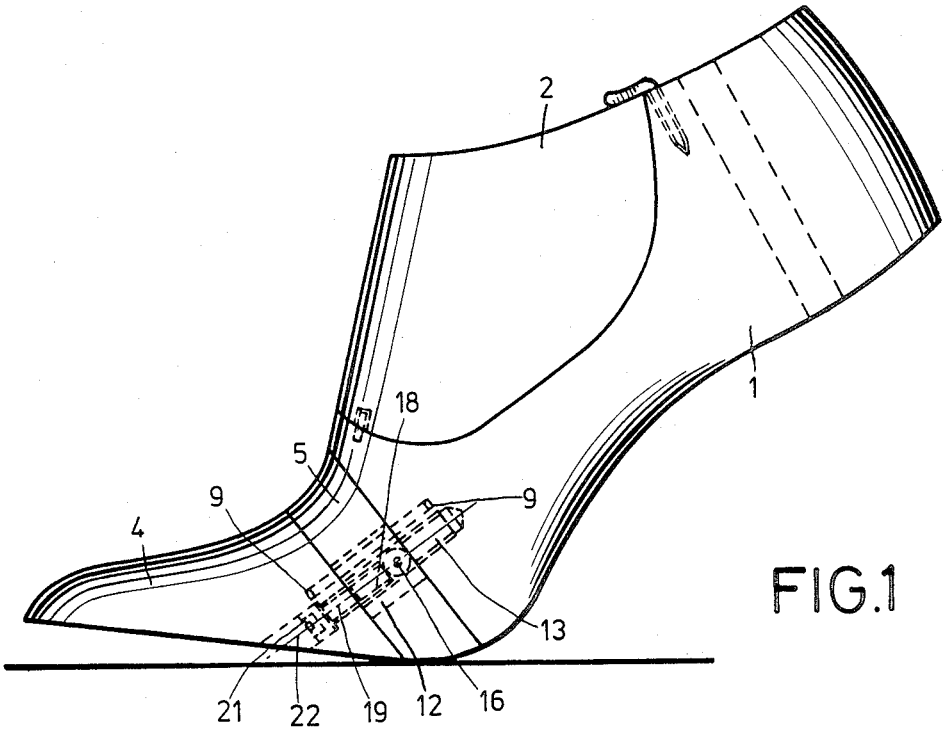
FIG. 1 is a side elevational view of a last made in accordance with the invention, illustrating a piece between a tip and a solid body of the last, the surfaces of which are parallel.

As can be seen from the drawings, the last of the invention comprises a solid body 1 provided with a corresponding unmolding block or wedge 2.

On a forward planar surface 3 of the solid body 1 there is disposed a tip or toe portion 4 via a third or intermediate member 5. Member 5 is so arranged that a rear planar surface 6 of the tip 4 contacts a forward planar surface 7 of member 5, while a rear planar surface 8 of the intermediate member 5 contacts the forward surface 3 of the solid body 1.

Figure 2:
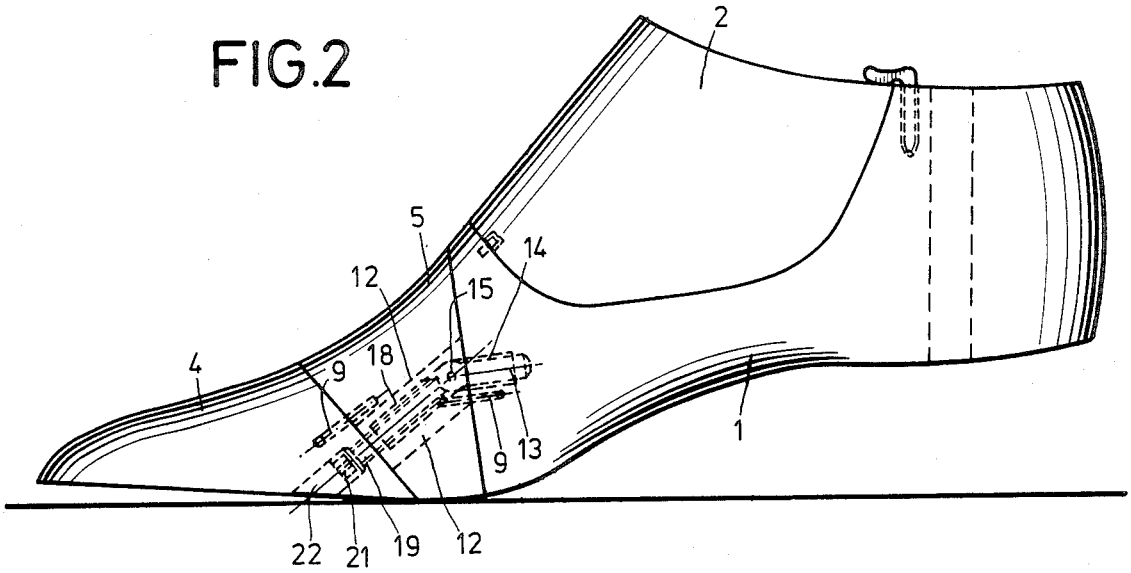
FIG. 2 is an elevational view similar to FIG. 1, but wherein the surfaces of the piece are inclined, i.e. not parallel.
Figure 3:
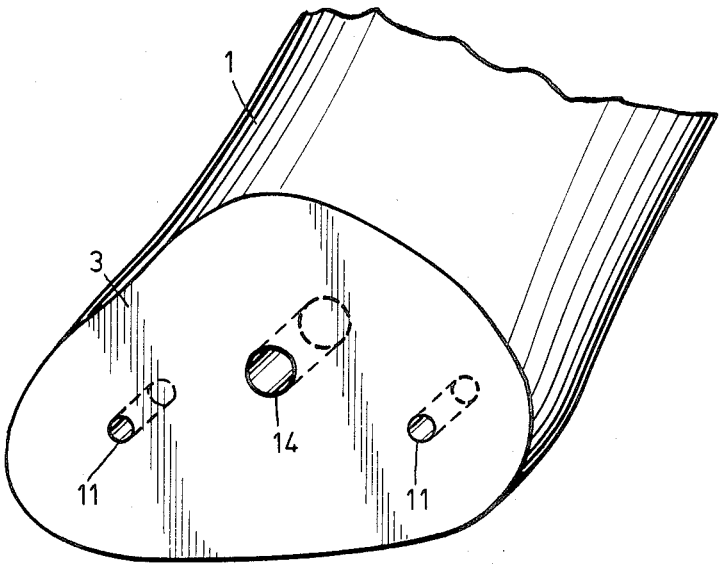
FIG. 3 is a front elevational view of the solid body of the last.
Figure 4:
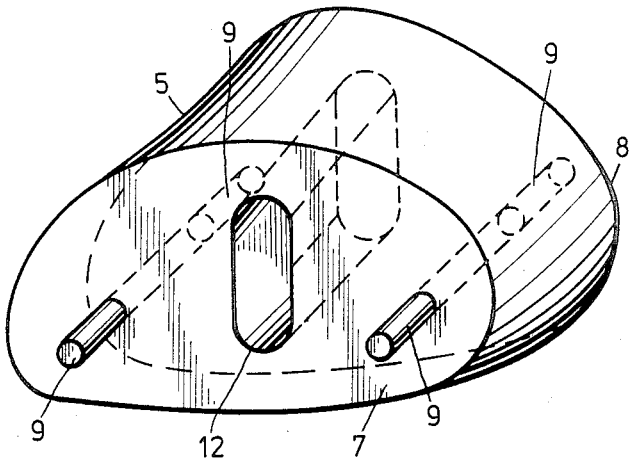
FIG. 4 is a perspective view of the intermediate piece in accordance with the invention.
Figure 5:
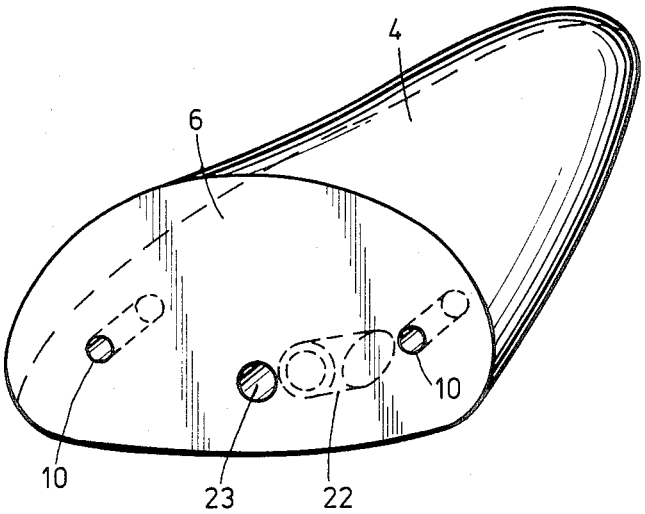
FIG. 5 is a rear perspective view of the tip of the last.
Figure 6:
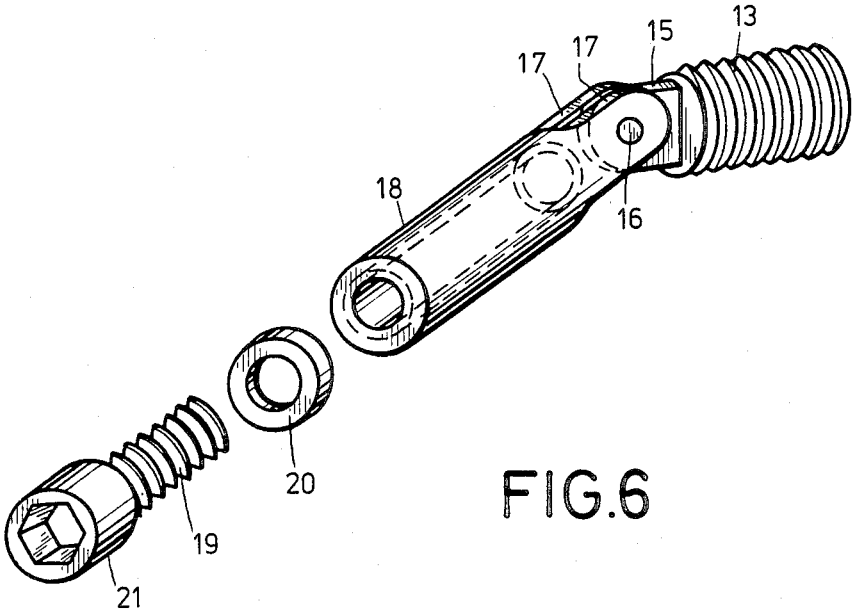
FIG. 6 is a perspective view of the structure for joining the tip to the solid body through the intermediate piece.

Surfaces 7 and 8 of the member 5 can be parallel (FIG. 1) or inclined to each other in an angular position (FIG. 2), depending on the height to be given to the heel of the shoe. The height of the heel will depend on the shape of the last which, in this case, is dependent on the shape of the member 5. As illustrated in FIG. 1, surfaces 7 and 8 of the member 5 are arranged in a parallel position corresponding to the maximum height of the shoe, while in FIG. 2 the surfaces 7 and 8 of the member 5 are in an inclined position corresponding to the minimum height to be given to the heel.

The member 5 has extending vertically from surfaces 7 and 8 stems or pins 9, capable of being housed in holes 10 of the surface 6 of the tip 4 and in holes 11 of the forward surface 3 of the solid body 1.

Extending longitudinally through the center of member 5 is a large hole 12 for the passage therethrough of means for joining the solid body 1 to the tip 4, with member 5 being positioned therebetween. The means for joining the solid body 1 to the tip 4 comprises a stem 13 which is threaded in a hole or housing 14 formed in forward surface 3 of the solid body 1. Threaded stem 13 has a tongue-like head 15 hinged by a transverse shaft 16 between two lugs 17 forming one end of an intervally threaded sleeve 18. Inside the sleeve 18 there can be threaded a screw or bolt 19 with the help of a washer 20. The screw 19 has a head 21 which is housed in a recess 22 provided at the lower zone of the tip 4, the head 21 having driver structure. The recess 22 is formed from the bottom of the tip 4 and communicates with the surface 6 of the tip 4 by means of a hole 23.

Based on this structure, joining between the tip 4 and the body 1 of the last is as follows:

The stem 13 is threaded in the hole 14 of the solid piece 1.

In this arrangement, the sleeve 18 passes through the slit hole 12 of the intermediate member 5. The screw 19 is inserted through recess 22 and hole 23 and is threaded into sleeve 18. The head 21 is retained in recess 22 and is driven from the bottom of the tip.

The hinging 16 between the sleeve 18 and the screw 13 allows the tip 4 to be joined to the last 1 through any shape of the intermediate member 5, depending on the degree of the angle between the surfaces 7 and 8 thereof.

With this structure a single solid body 1 can be used to make various shoe models by merely varying the shape of the tip 4, and body 1 can also be used for any type of shoe depending on the height of the heel, such that is necessary only to vary the angular position of the surfaces 7 and 8 of member 5. By varying the members 5, there will be obtained different angles of the last corresponding to the desired height of the heel of the shoe.

I claim:

1. In a last structure of the type including a main body portion provided with an unmolding block, and a plurality of toe portions selectively joinable to said main body portion, the improvement of means for adjusting the last structure to various heel heights of shoes to be formed thereon, said adjusting means comprising:

a plurality of interchangeable intermediate members adapted to be selectively connected between said main body portion and a selected said toe portion;

each said intermediate member having a rear surface to abut a complementary shaped forward surface of said main body portion and a forward surface to abut a complementary shaped rear surface of said selected toe portion;

said rear and forward surfaces of each said intermediate member extending at a relative orientation different from that of other said intermediate members, whereby connection of respective said intermediate members between said main body portion and said selected toe portion will result in corresponding changes of the orientation of said main body portion with respect to said selected toe portion; and means for connecting a respective said intermediate member between said main body portion and said selected toe portion, said connecting means being adjustable to said changes of orientation to accommodate and be employable with all of said intermediate members.

2. The improvement claimed in claim 1, wherein said rear and forward surfaces of each said intermediate member in said complementary surfaces of said main body portion and said selected toe portion comprise planar surfaces.

3. The improvement claimed in claim 2, further comprising pins extending from said rear and forward surfaces of each said intermediate members, said pins fitting into matching blind holes formed in respective said complementary surfaces.

4. The improvement claimed in claim 3, wherein each said pin extends perpendicularly from the respective said surface.

5. The improvement claimed in claim 1, wherein said connecting means comprises a hole extending into said main body portion from said forward surface thereof, a central opening extending through each said intermediate member, a recess extending into said toe portion from the bottom thereof, a hole extending from said recess to said rear surface of said toe portion, a stem fixed into said hole in said main body portion, an internally threaded sleeve connected to said stem and extending forwardly therefrom through said central opening in said respective intermediate member, and a bolt having a head received in said recess and extending therefrom through said hole in said toe portion and threaded into said internally threaded sleeve.

6. The improvement claimed in claim 5, wherein said stem is threaded into said hole in said main body portion.

7. The improvement claimed in claim 5, wherein said sleeve is pivotally connected to said stem, thereby enabling said sleeve to extend at different angles with respect to said stem to accommodate said changes of orientation.

8. The improvement claimed in claim 5, wherein said bolt head includes driver means to enable rotation of said bolt.

* * * * *